US007384320B2

(12) United States Patent
Ha

(10) Patent No.: US 7,384,320 B2
(45) Date of Patent: Jun. 10, 2008

(54) POWER TRAIN OF A MARINE TRANSPORT VESSEL

(76) Inventor: Tae-Hwan Ha, Byucksan Apt. 10-1403, 271-3, Hagye-dong, Nowon-gu, Seoul (KR) 139-230

( * ) Notice: Subject to any disclaimer, the term of this patent is extended or adjusted under 35 U.S.C. 154(b) by 162 days.

(21) Appl. No.: 10/533,053

(22) PCT Filed: Oct. 29, 2003

(86) PCT No.: PCT/KR03/02298

§ 371 (c)(1),
(2), (4) Date: Apr. 27, 2005

(87) PCT Pub. No.: WO2004/039668

PCT Pub. Date: May 13, 2004

(65) Prior Publication Data

US 2006/0166572 A1 Jul. 27, 2006

(30) Foreign Application Priority Data

Oct. 31, 2002 (KR) ..... 10-2002-0067174

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS

| | | | | |
|---|---|---|---|---|
| 3,112,728 | A * | 12/1963 | Krause | 440/75 |
| 3,922,997 | A * | 12/1975 | Jameson | 440/75 |
| 3,974,718 | A | 8/1976 | Kylberg | 74/750 R |
| 5,085,302 | A | 2/1992 | Kriesels | 192/51 |
| 5,664,978 | A * | 9/1997 | Howe | 440/75 |
| 6,186,922 | B1 | 2/2001 | Bursal et al. | 476/18 |

FOREIGN PATENT DOCUMENTS

| | | |
|---|---|---|
| GB | 2094922 A * | 9/1982 |
| JP | 01-164699 | 6/1989 |
| JP | 05-105191 | 4/1993 |
| JP | 06-200783 | 7/1994 |
| JP | 09-301275 | 11/1997 |
| KR | 10-0292325 | 3/2001 |

* cited by examiner

*Primary Examiner*—Jesús D Sotelo
(74) *Attorney, Agent, or Firm*—Lexyoume IP Group, LLC

(57) ABSTRACT

Propellers of a marine transport vessel may be independently controlled at their optimal speed when at least one transmission having a plurality of output shafts capable of independent-speed ratios is connected to an engine and the propellers are respectively mounted at the output shafts of the transmission.

10 Claims, 3 Drawing Sheets

POWER TRAIN OF A MARINE TRANSPORT VESSEL

This is the U.S. national phase of International Application No. PCT/KR2003/002298 filed Oct. 29, 2003, the entire disclosure of which is incorporated herein by reference.

BACKGROUND OF THE INVENTION (a) Field of the Invention

The present invention relates to a power train of a marine transport vessel, and more particularly, to a power train that can control a plurality of propellers with various speeds even if only one engine is adopted.

(b) Description of the Related Art

As is well known in the art, various kinds of marine transport vessels are used for transportation of passengers or cargo on water such as lakes, rivers, and oceans.

Such a marine transport vessel includes an engine for generating power and a transmission for transmitting the generated power to propellers. Usually, such an engine and a transmission are collectively called a power train. Hereinafter, the term "propeller" is used to include not only a conventional propeller for generating water current but also any rotating device for generating a reactive force to a body of the marine transport vessel. The term "marine transport vessel" is used to mean any marine vessel that moves by the reactive force of the propeller. In more detail, the marine transport vessel does not necessarily move on the water, but it may rather move under the water.

The transmission may be realized in a variety of forms, such as an automatic transmission or a manual transmission. However, a semi-automatic transmission described in Korean Patent No. 292325 (of which the filing no. is 10-1998-0063295) is very effective.

According to a conventional power train of such a transport vessel, an engine such as an internal combustion engine outputs power (i.e., torque) through one output shaft and a transmission that receives the output torque changes the rotational speed and then transmits it to a propeller. During such a power transmission, only one speed-ratio is realized.

According to such a conventional scheme of a power train, a power transmission pattern is very limited since the torque output from an engine having only one output shaft is changed by only one speed-ratio and is then transmitted to the propellers. That is, one engine can operate one or more propellers only at the same speed.

As a result, the behavior of a marine transport vessel is also limited. For example, for changing the direction of the vessel, rudders to the rear of the propellers are operated such that a direction of a reactive force is changed and thereby a torque for turning the direction of the vessel is generated. The turning radius of the vessel is consequently very large, as is well known in the art.

When such a turning radius of a vessel is reduced, various merits can be accordingly achieved. For example, the vessel may turn in a narrow region and accordingly interference between vessels may be minimized.

In order to provide different torques to different propellers, the vessel may adopt a plurality of engines and a plurality of transmissions respectively connected to the engines. However, in this case, torques of the separate engines are not easy to harmonize, and a large space is inevitably consumed by the engines and the transmissions.

SUMMARY OF THE INVENTION

Therefore, one object of the present invention is to provide a power train of a marine transport vessel that may transmit different torques at different speed-ratios to a plurality of propellers even if only one engine is adopted.

In order to achieve such an object, a power train of a marine transport vessel according to the present invention includes: an engine having at least one output shaft; at least one transmission connected to the at least one output shaft of the engine, the at least one transmission comprising a plurality of output shafts capable of independent speed-ratios; and a propeller connected to each output shaft of the transmission.

It is preferable that: the at least one output shaft of the engine is provided as a plurality; each of the at least one transmission is respectively connected to each of the plurality of output shafts of the engine; and said each of the at least one transmission comprises a plurality of output shafts capable of independent speed-ratios.

In addition, it is preferable that: the engine comprises a plurality of pistons for each cylinder; the plurality of pistons for each cylinder reciprocate in a horizontally opposed manner; and the plurality of pistons for each cylinder are separately connected to the output shafts of the engine.

It is also preferable that the at least one transmission comprises: first and second drive shafts rotating cooperatively with the output shaft of the engine; at least one first drive gear and at least one second drive gear respectively formed on the first and second drive shafts; and first and second multi-speed mechanisms respectively connected to the at least one first drive gear and the at least one second drive gear.

It is further preferable that each of the first and second multi-speed mechanisms comprises a plurality of planetary gearsets, the plurality corresponding to a predetermined number of shift-speeds.

In particular, it is preferable that at least one planetary gearset in each of the first and second multi-speed mechanisms rotates in an opposite direction to at least one other planetary gearset in each multi-speed mechanism.

It is preferable that: each of the planetary gearsets comprises a sun gear, a ring gear, and a carrier; the ring gear is engaged with a corresponding drive gear among the first and second drive gears; the sun gear is connected to the output shaft of the transmission; and each of the first and second multi-speed mechanisms further comprises a brake for selectively stopping the carrier.

In particular, it is preferable that as many drive gears are provided as there are ring gears in the multi-speed mechanism such that each drive gear is engaged with a corresponding ring gear.

DETAILED DESCRIPTION OF THE PREFERRED EMBODIMENTS

An embodiment of the present invention is hereinafter described in detail with reference to the drawings.

Figure 1:
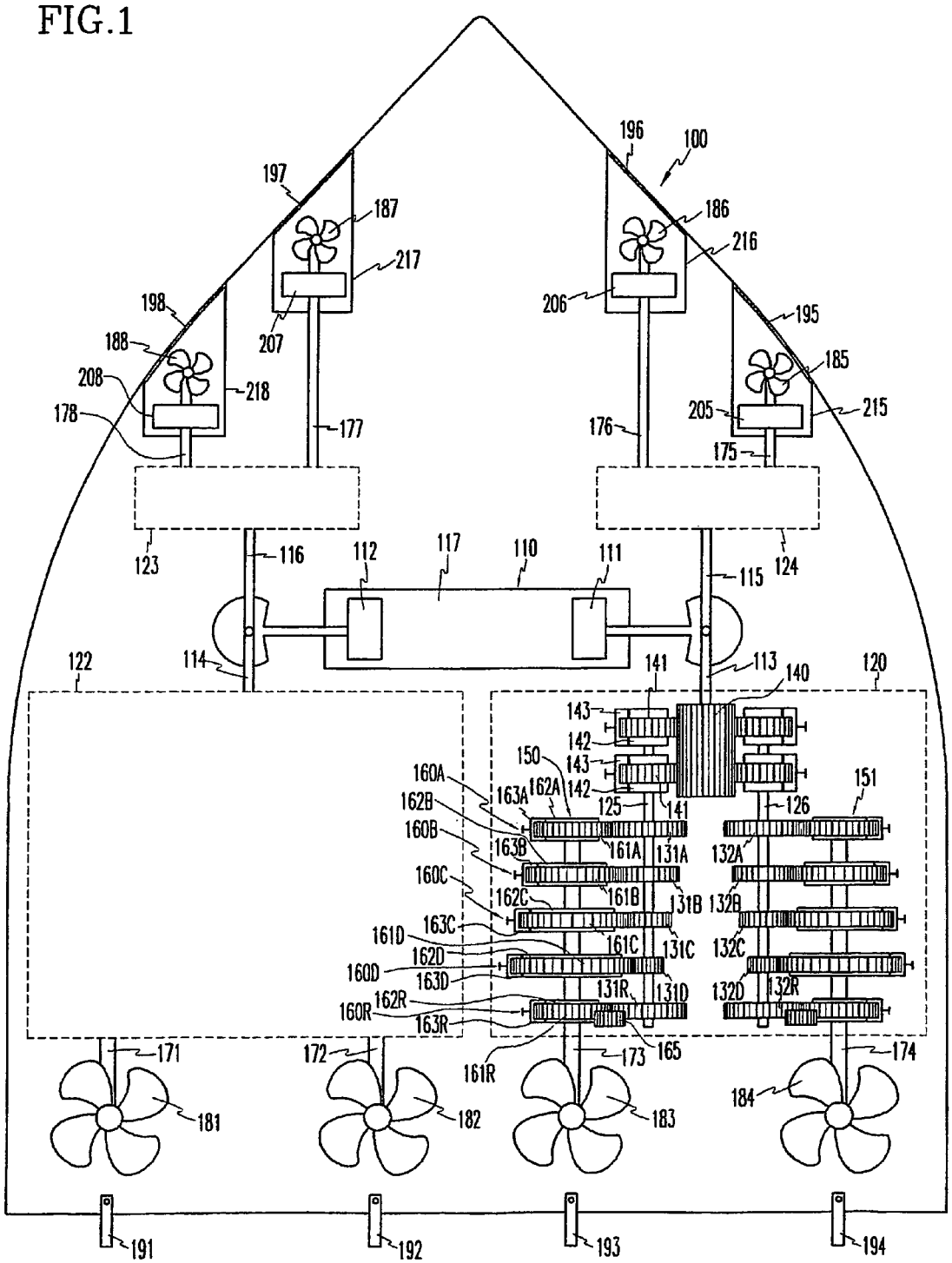
FIG. 1 is a schematic diagram of a power train of a marine transport vessel according to an embodiment of the present invention.

FIG. 1 is a schematic diagram of a power train of a marine transport vessel (e.g., a ship) according to an embodiment of the present invention.

As shown in FIG. 1, a power train of an embodiment of the present invention includes an engine 110. The engine 110 is provided with a plurality of output shafts 113 and 114. Transmissions 120 and 122 are respectively connected to the output shafts 113 and 114. The transmission 120 is provided with a plurality of output shafts 173 and 174, and realizes independent speed-ratios therethrough, while the transmission 122 is provided with a plurality of output shafts 171 and 172, and realizes independent speed-ratios therethrough.

As shown in FIG. 1, the engine 110 is a horizontally opposed engine in which each cylinder 117 has two pistons 111 and 112 that reciprocate in a horizontally opposed manner, and the two pistons 111 and 112 are respectively connected to the output shafts 113 and 114 to The left and right pistons 112 and 111 of the engine 110 respectively output combustion power of the cylinder 117 to the left and right output shafts 114 and 113. The reciprocating motion of the pistons 111 and 112 may be synchronized by a timing device such as a timing belt.

As described above, the left and right output shafts 114 and 113 are connected to transmissions, each of which has output shafts of independent speed-ratios. Since the transmission 122 connected to the left output shaft 114 and the transmission 120 connected to the right output shaft 113 may be symmetrically realized, the right transmission 120 is hereinafter described in further detail.

As shown in FIG. 1, the right transmission 120 includes first and second drive shafts 125 and 126 that rotate cooperatively with the right output shaft 113 of the engine.

First drive gears 131A, 131B, 131C, 131D, and 131R are formed on the first drive shaft 125. A first multi-speed mechanism 150 is connected to the first drive gears 131A, 131B, 131C, 131D, and 131R.

In the same way, second drive gears 132A, 132B, 132C, 132D, and 132R are formed on the second drive shaft 126, and a second multi-speed mechanism 151 is connected to the second drive gears 132A, 132B, 132C, 132D, and 132R.

A cooperative relationship among the second drive shaft 126, the second drive gears 132A, 132B, 132C, 132D, and 132R, the second multi-speed mechanism 151, and the right output shaft 113 is symmetrical to a cooperative relationship among the first drive shaft 125, the first drive gears 131A, 131B, 131C, 131D, and 131R, the first multi-speed mechanism 150, and the right output shaft 113. Therefore, the cooperative relationship among them is hereinafter described in further detail in connection with the first drive shaft 125.

The rotation of the first drive shaft 125 cooperative with the right output shaft 113 may be realized, as shown in FIG. 1, by an engagement of a gear 140 formed on the right output shaft 113 and gears 141 formed on the first drive shaft 125. In this case, the first and second drive shafts 125 and 126 rotate in the same direction.

Each gear 141 formed on the first drive shaft 125 is realized as a ring gear of a planetary gearset, of which a carrier 142 carrying pinion gears is selectively stopped by an external brake 143, and a sun gear (not shown) is fixed to the first drive shaft 125. In this way, a common speed-ratio that acts commonly at each shift-speed of the first multi-speed mechanism 150 may be achieved. By adopting a plurality of gears 141 on the first drive shaft 125 and realizing each of the gears 141 as a ring gear of a planetary gearset, the common speed-ratio may be pluralized.

In the same way, a common speed-ratio may also be achieved for the second multi-speed mechanism 151, and the common speed-ratio of the second multi-speed mechanism may also be pluralized.

The first and second multi-speed mechanisms used in an embodiment of the present invention may be realized as a shifting device used in a semi-automatic transmission disclosed in the above-mentioned Korean Patent No. 292325 (filing no. 10-1998-0063295).

As discussed above and as shown in FIG. 1, the second drive gears 132A, 132B, 132C, 132D, and 132R, and the second multi-speed mechanism 151 are structured symmetrical to the first drive gears 131A, 131B, 131C, 131D, and 131R, and the first multi-speed mechanism 150. Therefore, the first drive gears 131A, 131B, 131C, 131D, and 131R, and the first multi-speed mechanism 150 are hereinafter described in further detail.

The first multi-speed mechanism 150 includes planetary gearsets 160A, 160B, 160C, 160D, and 160R, the number of which is as many as a predetermined number of shift-speeds thereof. FIG. 1 exemplarily illustrates four forward shift-speeds and one reverse shift-speed, but the number of the forward/reverse shift-speeds may be altered obviously by a person of ordinary skill in the art. In particular, although only one reverse shift-speed is illustrated in FIG. 1, the reverse shift-speed may also be pluralized to as many as or a different number from the forward shift-speeds. As is well known in the art, one planetary gearset has three operational elements of a sun gear, a ring gear, and a carrier. Therefore, when a torque is input through one element of the three and another element is fixed (i.e. rotation thereof is stopped), the torque is output through a remnant element.

In the same way, planetary gearsets 160A-160R used in the first multi-speed mechanism 150 of an embodiment of the present invention respectively include sun gears (not shown), ring gears 161A-161R, and carriers 162A-162R. The ring gears 161A-161R are respectively engaged with the drive gears 131A-131R, and the sun gears (not shown) are fixedly connected to the output shaft 173 of the right transmission 120. In addition, the first multi-speed mechanism 150 of an embodiment of the present invention further includes brakes 163A-163R for selectively stopping the carriers 162A-162R. By constructing input elements and output elements as such, the structure of the multi-speed mechanism may be simplified.

As is known in the art, a speed-ratio of a planetary gearset may be altered by changing a ratio of a radius of a sun gear to a radius of a ring gear. Therefore, diameters of the drive gears 131A-131R are not necessarily different but may be realized as one diameter value. That is, as is disclosed in the above-mentioned Korean Patent No. 292325, different speed-ratios may be achieved by stopping carriers of different planetary gearsets included in the multi-speed mechanism 150 while torque is transmitted to the ring gears 161A-161R of the planetary gearsets 160A-160R through one drive gear.

However, more preferably, as shown in FIG. 1, a wider range of speed-ratios may be achieved by transmitting torque to the planetary gearsets 160A-160R through respective drive gears 131A-131R.

The brakes 163A-163R for selectively stopping the carriers 162A-162R are obvious to a person of ordinary skill in the art or from the disclosure of the above-mentioned Korean Patent No. 292325.

When a carrier (e.g., 162B) of a planetary gearset (e.g., 160B) included in the first multi-speed mechanism 150 is stopped by an operation of a brake (e.g., 163B), the torque is changed by a speed-ratio determined by a specification of the planetary gearset (i.e., 160B) that has its carrier (i.e., 162B) fixed, and the changed torque is output through the output shaft 173 of the first multi-speed mechanism 150. Therefore, a propeller 183 connected to the output shaft 173 rotates and generates water current, and thereby a vessel 100 moves by a reactive force of the water current.

The sun gear (not shown) of the planetary gearset 160R among the planetary gearsets 160A-160R used in the multi-speed mechanism 150 rotates, when its carrier 163R is stopped, in an opposite direction in which sun gears (not shown) of other planetary gearsets 160A-160D rotate when their carriers 162A-162D are stopped. That is, the planetary gearset 160R outputs torque reverse to that of the other planetary gearsets 160A-160D.

Such a function may be realized in a variety of schemes, for example through a different number of pinion gears in the reverse planetary gearset. In addition, an idle gear 165 may be disposed between the ring gear 161R and the driver gear 131R, as shown in FIG. 1.

According to the above scheme of a power train, the vessel 100 has four propellers 181, 182, 183, and 184 connected to one engine 110, and each of the propellers 181, 182, 183, and 184 may have a different rotation speed because of the transmissions 120 and 122. In particular, some propellers may rotate reversely to other propellers.

Therefore, for example, when a leftmost propeller 181 of the vessel 100 is reversely operated and a rightmost propeller 184 is normally operated, the rightmost propeller 184 exerts a forward propulsive force to the vessel 110, and the left most propeller 181 exerts a rearward propulsive force thereto. So, a rotating torque is generated around the vessel body, and therefore, the vessel 100 may rotate at its stationary position without requiring a large turning radius.

Figure 2:
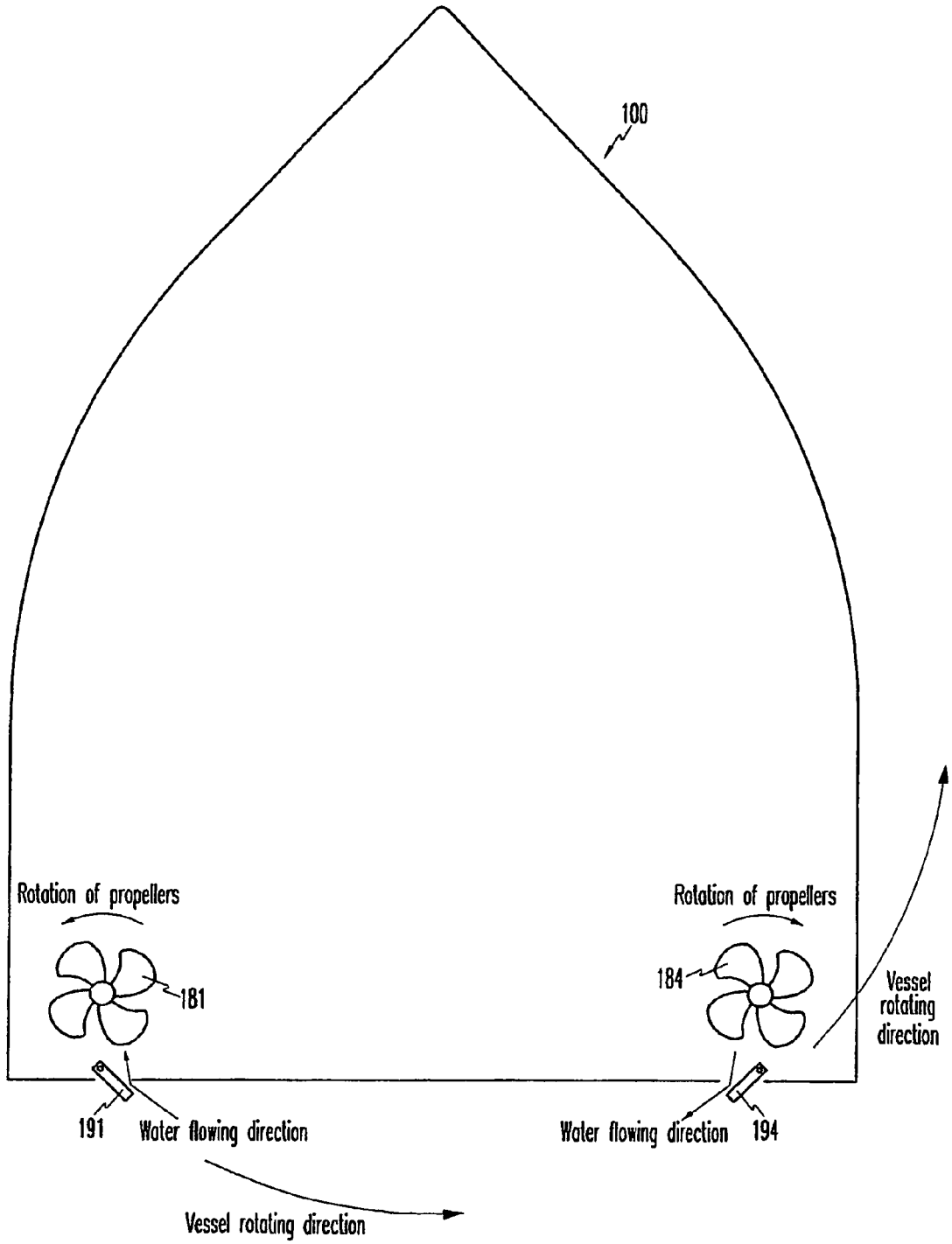
FIG. 2 illustrates an exemplary turning strategy of a marine transport vessel by a power train of a marine transport vessel according to an embodiment of the present invention.

When rudders 191, 192, 193, and 194 are provided at the rear of the propellers as shown in FIG. 1, such a rotation of a vessel 100 becomes easier. That is, as shown in FIG. 2, by positioning the rudder 194 at the rear of the right propeller 184 and the rudder 191 at the rear of the left propeller 181 in opposite directions, rotating torques generated by the propellers may be maximized. Positioning of rudders shown in FIG. 2 may be variously altered by a person of ordinary skill in the art.

For a better preferable embodiment of the present invention, as shown in FIG. 1, the horizontally opposed engine 110 is provided with output shafts 115 and 116 extending to a front of the marine transport vessel 100, symmetrically to the output shafts 113 and 114 to the rear of the marine transport vessel 100. The output shafts 115 and 116 are respectively connected to transmissions 124 and 123 that are structured the same as the previously-described transmissions 120 and 122.

The transmission 124 is provided with a plurality of output shafts 175 and 176, and realizes independent speed-ratios therethrough. The transmission 123 is provided with a plurality of output shafts 177 and 178, and realizes independent speed-ratios therethrough.

Propellers 185, 186, 187, and 188 are respectively connected to front ends of the output shafts 175, 176, 177, and 178, and they are enclosed in the vessel body. That is, the propellers 185, 186, 187, and 188 are respectively contained in containing cavities 215, 216, 217, and 218 formed at the vessel body Covers 195, 196, 197, and 198 are formed along a surface of the vessel body in front of the propellers 185, 186, 187, and 188 such that a front surface of the vessel body is normally smooth. The containing cavities 215, 216, 217, and 218 seal the output shafts 175, 176, 177, and 178 such that water does not leak into the vessel body when the covers 195, 196, 197, and 198 are open.

Length control apparatus 205, 206, 207, and 208 are respectively formed at the output shafts 175, 176, 177, and 178 for enabling changing of lengths thereof. In order to rotate the propellers 185, 186, 187, and 188, the covers 195, 196, 197, and 198 are opened and the length control apparatus 205, 206, 207, and 208 are operated such that the output shafts 175, 176, 177, and 178 are elongated. Accordingly, the propellers 185, 186, 187, and 188 protrude to the exterior of the vessel body and are then rotated. The length control apparatus 205, 206, 207, and 208 may be realized in a variety of fashions by a person of ordinary skill in the art. Hereinafter, an embodiment of the length control apparatus 205 formed at the output shaft 175 is described with reference to FIG. 3. From the following description with reference to FIG. 3, the length control apparatus 206, 207, and 208 formed at other output shafts 176, 177, and 178 will be obviously understood by a person of ordinary skill in the art.

Figure 3:
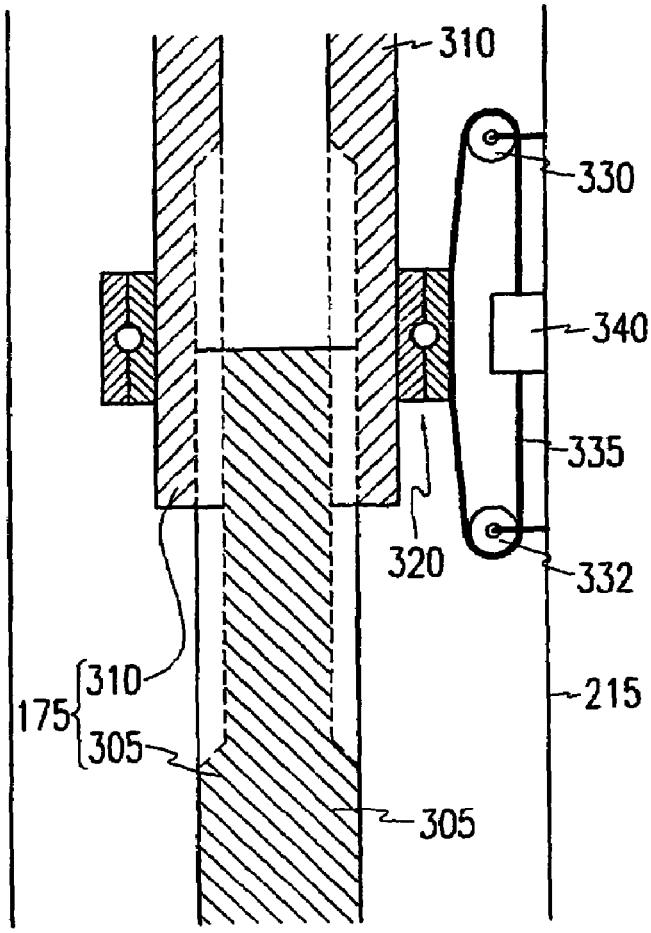
FIG. 3 illustrates an embodiment of a length control apparatus used in a power train of a marine transport vessel according to an embodiment of the present invention.

As shown in FIG. 3, the output shaft 175 is divided into upper and lower output shafts 310 and 305, and they are spline-engaged with each other. Therefore, the lower and upper output shafts 305 and 310 may relatively move in a vertical direction in FIG. 3.

For such a relative movement, a bearing 320 is mounted on an exterior side of the upper output shaft 310, and an exterior side of the bearing 320 is connected, by a belt 335, to a motor 340 fixed at the containing cavity 215. The belt 335 may smoothly operate by roller bearings 330 and 332 fixed in the containing cavity 215 at positions above and below the motor 340.

Therefore, when the motor 340 is operated, a total length of the output shaft 175 becomes changed in accordance with an operating direction of the motor 340.

By such a preferable embodiment of the present invention, i.e., by disposing a plurality of propellers forwardly to the vessel body, the marine transport vessel 100 may decelerate more rapidly, and it may also move in a reverse direction. Furthermore, a turning radius thereof may be further reduced.

In addition, the covers normally cover the propellers (i.e., the containing cavities) such that an influence on an outline of the vessel 100 is minimized. Therefore, in normal forward sailing, friction with water is minimized.

For a reverse movement or a rapid deceleration of the vessel 100, the covers are opened, and the propellers protrude exterior to the vessel body by extending due to operation of the length control apparatus. In this state, the propellers rotate, so that the vessel body can rapidly decelerate or move rearwardly.

In addition, the transmissions 123 and 124 connected to the propellers at the front of the vessel body may be respectively shifted to reverse ranges, and the front propellers may also have different speeds and thereby provide easier rotation of the vessel body.

When rotation speeds and directions of front and rear propellers of the vessel are optimized, the turning radius of the vessel is further reduced and the turning speed is further enhanced, as is obvious to a person of ordinary skill in the art.

According to an embodiment of the present invention, a plurality of propellers are respectively operated at their optimal speeds even if only one engine is provided at a vessel, so the performance of the vessel may be enhanced.

In addition, when the engine has a plurality of output shafts, the number of propellers that can be optimally controlled may be equivalently increased.

Furthermore, each propeller is optimally controlled since separate transmissions are provided to output shafts of the engine, and each transmission controls its output shaft with independent speed-ratios.

A clutching function is realized by a multi-speed mechanism included in the transmission, so an additional clutch device for controlling power transmission from an engine to propellers is not needed. Therefore, a power train of a vessel may be simplified.

Since the engine is realized as a horizontally opposed engine, the height of a mass center of a power train may be lowered, and thereby the stability of a vessel body may be enhanced.

Since each propeller may be controlled at a speed independent from others and at least one propeller may be reversely rotated, turning radius of the vessel body is reduced.

Since the propellers may reversely rotate under the power of the engine, the vessel may decelerate, using the power of the engine, more rapidly than conventional marine transport vessels that only decelerate by friction with water.

While this invention has been described in connection with a preferred embodiment, it is to be understood that the invention is not limited to the disclosed embodiments, but, on the contrary, is intended to cover various modifications and equivalent arrangements included within the spirit and scope of the appended claims.

Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. A power train of a marine transport vessel comprising:

an engine having at least one output shaft;

at least one transmission connected to the at least one output shaft of the engine, the at least one transmission directly driving a respective plurality of output shafts at independent plurality of speed-ratios; and a propeller connected to each output shaft of the transmission, wherein:

the at least one output shaft of the engine is provided as a plurality;

each of the at least one transmission is respectively connected to each of the plurality of output shafts of the engine; and said each of the at least one transmission comprises a plurality of output shafts capable of independent speed-ratios.

2. The power train of claim 1, wherein the plurality of output shafts of the engine comprise output shafts extending forward and rearward from the engine with respect to a vessel body.

3. The power train of claim 2, wherein the output shaft extending forward from the engine with respect to the vessel body is adjustable in its length.

4. The power train of claim 3, further comprising a front propeller connected to the output shaft extending forward from the engine with respect to the vessel, wherein the front propeller is contained in a containing cavity inwardly formed at the vessel body, and a cover is provided at a vessel body side end of the containing cavity.

5. The power train of claim 1, wherein:

the engine comprises a plurality of pistons for each cylinder;

the plurality of pistons for each cylinder reciprocate in a horizontally opposed manner; and the plurality of pistons for each cylinder are separately connected to the output shafts of the engine.

6. The power train of claim 1, wherein the at least one transmission comprises:

first and second drive shafts rotating cooperatively with the output shaft of the engine;

at least one first drive gear and at least one second drive gear respectively formed on the first and second drive shafts; and first and second multi-speed mechanisms respectively connected to the at least one first drive gear and the at least one second drive gear.

7. The power train of claim 6, wherein each of the first and second multi-speed mechanisms comprises a plurality of planetary gearsets, the plurality corresponding to a predetermined number of shift-speeds.

8. The power train of claim 7, wherein:

each of the planetary gearsets comprises a sun gear, a ring gear, and a carrier;

the ring gear is engaged with a corresponding drive gear among the first and second drive gears;

the sun gear is connected to the output shaft of the transmission; and each of the first and second multi-speed mechanisms further comprises a brake for selectively stopping the carrier.

9. The power train of claim 8, wherein as many drive gears are provided as there are ring gears in the multi-speed mechanism such that each drive gear is engaged with a corresponding ring gear.

10. The power train of claim 7, wherein at least one planetary gearset in each of the first and second multi-speed mechanisms rotates in an opposite direction to at least one other planetary gearset in each multi-speed mechanism.

* * * * *